US009000056B2

(12) United States Patent
Bi et al.

(10) Patent No.: US 9,000,056 B2
(45) Date of Patent: Apr. 7, 2015

(54) METHOD FOR PRODUCING METHANE BY CATALYTIC GASIFICATION OF COAL AND DEVICE THEREOF

(75) Inventors: Jicheng Bi, Hebei (CN); Rong Zhang, Hebei (CN); Yixin Chen, Hebei (CN); Zhiqiang Sun, Hebei (CN); Jinlai Li, Hebei (CN); Zhongxue Gan, Hebei (CN)

(73) Assignee: Enn Science & Technology Development Co., Ltd., Hebei (CN)

( * ) Notice: Subject to any disclaimer, the term of this patent is extended or adjusted under 35 U.S.C. 154(b) by 544 days.

(21) Appl. No.: 13/496,035

(22) PCT Filed: Sep. 14, 2010

(86) PCT No.: PCT/CN2010/001408

§ 371 (c)(1), (2), (4) Date: Apr. 30, 2012

(87) PCT Pub. No.: WO2011/029284

PCT Pub. Date: Mar. 17, 2011

(65) Prior Publication Data

US 2012/0238646 A1 Sep. 20, 2012

(30) Foreign Application Priority Data

Sep. 14, 2009 (CN) ..... 2009 1 0170389

(51) Int. Cl.

| | |
|---|---|
| ***C07C 27/00*** | (2006.01) |
| ***C10J 3/68*** | (2006.01) |
| ***C10J 3/72*** | (2006.01) |
| ***C10J 3/16*** | (2006.01) |
| ***C10J 3/00*** | (2006.01) |
| ***C10L 3/08*** | (2006.01) |
| ***C10J 3/46*** | (2006.01) |
| ***C10K 1/00*** | (2006.01) |
| ***C10K 1/02*** | (2006.01) |
| ***C10K 1/30*** | (2006.01) |

(52) U.S. Cl.

CPC .. *C10L 3/08* (2013.01); *C10J 3/721* (2013.01); *C10J 2300/093* (2013.01); *C10J 2300/0986* (2013.01); *C10J 2300/1662* (2013.01); *C10J 3/463* (2013.01); *C10K 1/003* (2013.01); *C10K 1/02* (2013.01); *C10K 1/026* (2013.01); *C10K 1/30* (2013.01); *C10J 2300/0956* (2013.01); *C10J 2300/0976* (2013.01); *C10J 2300/1807* (2013.01)

(58) Field of Classification Search

USPC ..... 518/700, 702; 48/76, 87, 128, 202, 210, 48/214 A; 422/643

See application file for complete search history.

(56) References Cited

U.S. PATENT DOCUMENTS

| | | | | |
|---|---|---|---|---|
| 2008/0021119 | A1 | 1/2008 | Norbeck et al. | |
| 2009/0217584 | A1 | 9/2009 | Raman et al. | |
| 2011/0095233 | A1 * | 4/2011 | Hildebrandt et al. | 252/373 |

FOREIGN PATENT DOCUMENTS

| | | |
|---|---|---|
| WO | 2006/100572 | 9/2006 |
| WO | 2008/013794 | 1/2008 |

OTHER PUBLICATIONS

International Search Report, issued in corresponding International Application No. PCT/CN2010/001408, Jul. 2009.
Written Opinion, issued in corresponding International Application No. PCT/CN2010/001408, Jul. 2009.

* cited by examiner

*Primary Examiner* — Jafar Parsa
(74) *Attorney, Agent, or Firm* — Wood, Phillips, Katz, Clark & Mortimer

(57) ABSTRACT

The invention relates to a gasifier comprising a syngas generation section, a coal methanation section and a syngas methanation section in the order from bottom to top. The invention also relates to a process for preparing methane by catalytically gasifying coal using such a gasifier. Optionally, the gasifier is additionally provided with a coal pyrolysis section above the syngas methanation section.

36 Claims, 4 Drawing Sheets

METHOD FOR PRODUCING METHANE BY CATALYTIC GASIFICATION OF COAL AND DEVICE THEREOF

TECHNICAL FIELDS

The invention relates to a field of substitute natural gas production by gasifying coal, in particular, relates to a process for methane production by catalytic coal gasification, especially, relates to a process for methane production by catalytic coal gasification in a multi-sections gasifier.

BACKGROUNDS

With the rapid economic development and the increasingly strict environmental regulations, in the next ten years, China's demand for the clean energy of the natural gas will grow explosively, but the production of natural gas, though have increased, will still well lower than the increasing trend of its demand, so the contradiction between supply and demand has become increasingly prominent and the supply gap is increasing year by year. In view that China's energy source state is characterized in that coal is abundant, petroleum and natural gas are insufficient, so, an energy consumption structure that coal will be the major energy source will not change in the short term. According to the developing trend of clean coal technique and worldwide low-carbon economy, converting coal to natural gas, which is the best fuel among the fossil energy, is suitable for Chinese state and is a shortcut to eliminate energy crisis and ensure the energy safety.

Now, the process for preparing methane from coal can classified as indirect methanation and direct methanation. Indirect methanation is also called coal methanation process in two steps, wherein the first step is preparing syngas by gasifying coal, and the second step is preparing methane from the syngas (i.e., the purified coal gas in which $H_2$/CO ratio having been adjusted). The direct methanation of coal refers to a process in which the coal is directly converted to the methane-rich gas product under a certain temperature and pressure. In this direct methanation process, the coal gasification operation and methanation operation, are not two separate operation.

FIG. 1 and FIG. 2 represent two typical process of current indirect methanation. FIG. 1 represents a process using a methanation catalyst which is not tolerant to sulfur, wherein coal is firstly gasified in a gasifier to produce syngas (its main components is CO and $H_2$), then the syngas is subjected to primary purification procedure to remove dust, to cool down and to remove tar, then the syngas is coarsely desulfurized and finely desulfurized to remove the sulfide such as $H_2S$, COS contained therein until the sulfur content in the desulfurized syngas is below 0.1 ppm, so as not to poison the methanation catalyst, then the C/H ratio of the syngas is adjusted by CO shift reaction ($CO+H_2O \rightarrow CO_2+H_2$) to meet the catalyst's requirement, then the syngas is introduced into circulation methanation reactor to be converted into methane product. The carbon contained in methane product is removed to get final gas product. FIG. 2 represents a process using sulfur-tolerant methanation catalyst. FIG. 2 differs from FIG. 1 in that the syngas is directly introduced into the methanation reactor to carry out sulfur-tolerant methanation reaction, instead of being desulfurized prior to being introduced into the methanation reactor. Then the reacted gas is subjected to subsequent procedures such as desulfurization and decarbonization to obtain final gas product. In above process for preparing methane from coal, the coal is must converted to syngas firstly, then the syngas is pretreated to remove dust and to cool down to meet the requirement of the catalyst in the subsequent methanation reactor, so the process flowchart is complex and the energy cost of the system is big. Furthermore, the methanation reaction, which is a strong exothermic reaction, tends to make the temperature of catalyst in the reactor run away and to deactivate the catalyst and shorten the life of catalyst. So, how to effectively remove the heat from the reactor is a problem to design the reactor.

Exxon Corporation in USA has carried out much experimental studies to the process for preparing methane from coal by one-step process. U.S. Pat. No. 4,318,712 discloses a whole process chart for the direct methanation of coal, see FIG. 3, in which the coal is premixed with catalyst and then is introduced into a gasifier. The superheated steam is used not only as a gasifying agent but also as a heat source to maintain the reaction temperature in the gasifier at about 700° C. The temperature of the superheated steam is 850° C., and the reaction pressure of the gasifier is 3.5 MPa. Coal reacts with superheated steam under the action of catalyst and direct produced methane-rich gas product, as shown in FIG. 3.

GPE Corporation in USA has carried out further study on the base of the technique of EXXON Corporation. Patent US20070000177A1 also a process for preparing methane from coal, wherein the catalyst is alkali metal carbonate or alkali metal hydroxide, the gasify agent is steam. In addition to adding effective methanation catalyst, the main technical features of this patent include adding calcium oxide to the coal powders to absorb the carbon dioxide produced during the reaction, so as to increase the methane content further.

The shortages of above process are: adding catalyst which promotes the generation of methane, but the high temperature is not favor of the generation of methane, so the reaction temperature is controlled at about 700° C., the reaction rate is slow and the carbon conversion is low, the reaction temperature is hard to maintain if heat is not provided by an external heat supplying system. Moreover, these techniques are still in study phase.

U.S. Pat. No. 4,077,778 proposes a process for catalytically gasifying coal by using multiple stages fluidized bed. This process eliminate the shortage of previous process and let the gasification more effective by making good use of the feeding carbon resource and increasing carbon conversion. The operating gas velocity of the primary fluidized bed is relative high to entrain some carbon particles into secondary fluidized bed, where the gasification reaction is carried out at a relative low gas velocity. In this way the residence time of the solid is increased, so the carbon conversion is maximized. The multiple stages gasification can increase the carbon utilization rate from 70-85% to above 95%, compared with single stage gasification. This process for catalytically gasifying coal by using multiple stages fluidized bed uses several fluidized bed reactors, so the invest for the equipments is high and the operation is relatively complicated.

The invention made a modification to the traditional process for preparing methane from coal. The invention integrates three operation process, i.e., the preparation of syngas from coal, the catalytically methanation of coal and the methanation of syngas, into a single reactor, so as to make good use of the energy.

SUMMARY OF THE INVENTION

In one aspect, the invention relates to a process for preparing methane by catalytically gasifying coal, comprising steps:

(a) providing a gasifier comprising a syngas generation section, a coal methanation section and a syngas methanation section, and carrying out methanation reaction by reacting the coal with a syngas-including gas stream coming from the syngas generation section in the presence of coal methanation catalyst in the coal methanation section, so as to generate a methane-containing gas stream and reacted char;

(b) the reacted char enters downwardly the syngas generation section and reacts with a gaseous oxidant introduced into the syngas generation section, producing the syngas-including gas stream and ash residues, wherein the syngas-including gas stream enters upwardly the coal methanation section to carry out step (a), while the ash exits the gasifier; and, (c). the methane-containing gas stream from step (a) enters upwardly the syngas methanation section, and the syngas is subjected to methanation reaction in the presence of a syngas methanation catalyst to produce additional methane, so as to obtain a gaseous product containing more methane.

In other aspect, the invention also relates to A process for preparing methane by catalytically gasifying coal, comprising steps:

(a) providing a gasifier comprising a syngas generation section, a coal methanation section, a syngas methanation section and a coal pyrolysis section, and carrying out methanation reaction by reacting the coal with a syngas-including gas stream coming from the syngas generation section in the presence of coal methanation catalyst in the coal methanation section, so as to generate a methane-containing gas stream and reacted char;

(b) the reacted char enters downwardly the syngas generation section and reacts with a gaseous oxidant introduced into the syngas generation section, producing the syngas-including gas stream and ash residues, wherein the syngas-including gas stream enters upwardly the coal methanation section to carry out step (a), while the ash exits the gasifier; and, (c) the methane-containing gas stream from step (a) enters upwardly the syngas methanation section, and the syngas is subjected to methanation reaction in the presence of a syngas methanation catalyst to produce additional methane, so as to obtain a gaseous product containing more methane.

(d) the gaseous product containing more methane enters upwardly the coal pyrolysis section and heats the coal introduced into the coal pyrolysis section to pyrolyze the coal and produce additional methane, and all gases in this section exit the gasifier, while the pyrolyzed coal moves downwardly along the gasifier.

In a further aspect, the invention relates to an apparatus for preparing methane by catalytically gasifying coal, said apparatus is also called gasifier in the art, which comprises a syngas generation section, a coal methanation section and a syngas methanation section in the order from bottom to top, wherein, the coal methanation section is used to carry out methanation reaction by reacting the coal with a syngas-including gas stream coming from the syngas generation section in the presence of coal methanation catalyst, so as to generate a methane-containing gas stream and reacted char;

the syngas generation section is used to react the reacted char from coal methanation section with a gaseous oxidant introduced into the syngas generation section, producing the syngas-including gas stream and ash residues, wherein the syngas-including gas stream enters upwardly the coal methanation section, while the ash residues exit the gasifier;

the syngas methanation section is used to let the syngas in the methane-containing gas stream from the coal methanation section subjected to methanation reaction in the presence of a syngas methanation catalyst to produce additional methane, so as to obtain a gaseous product containing more methane.

It can be understood that, each figure is only illustrative, not to limit the scope of the invention in any way. The scope of the invention should be determined by appended claims.

DETAILED DESCRIPTION OF THE INVENTION

Figure 1:
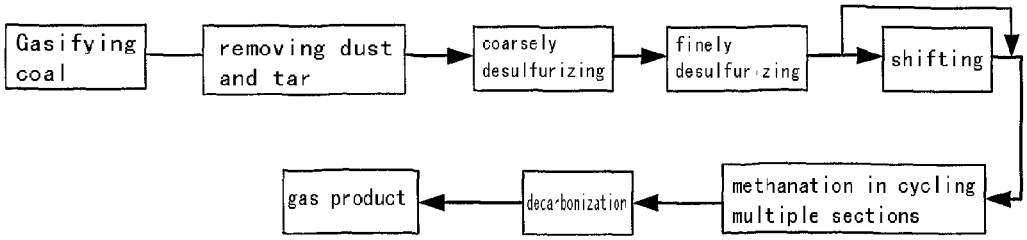
FIG. 1 is the schematic flowchart of indirect methanation process in the art, wherein a methanation catalyst which is not tolerant to sulfur is used.
Figure 2:
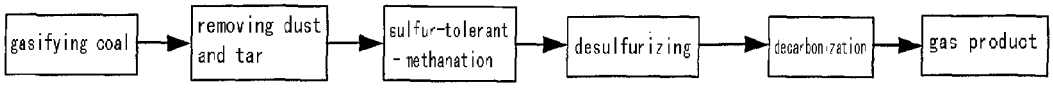
FIG. 2 is the schematic flowchart of indirect methanation process in the art, wherein a sulfur-tolerant methanation catalyst is used.
Figure 3:
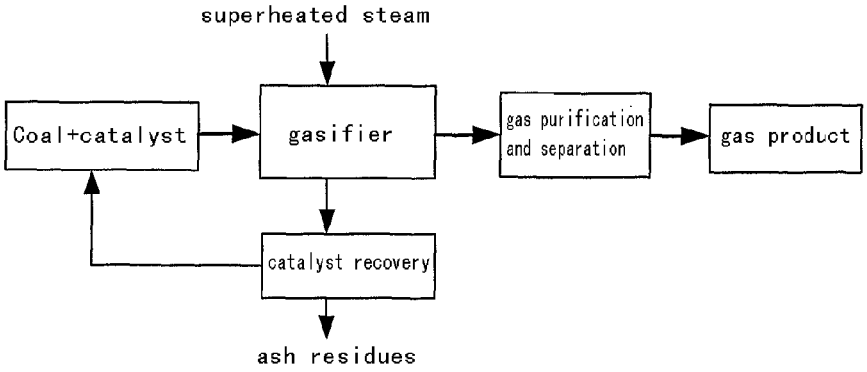
FIG. 3 is the schematic flowchart of direct methanation process in the art.
Figure 4:
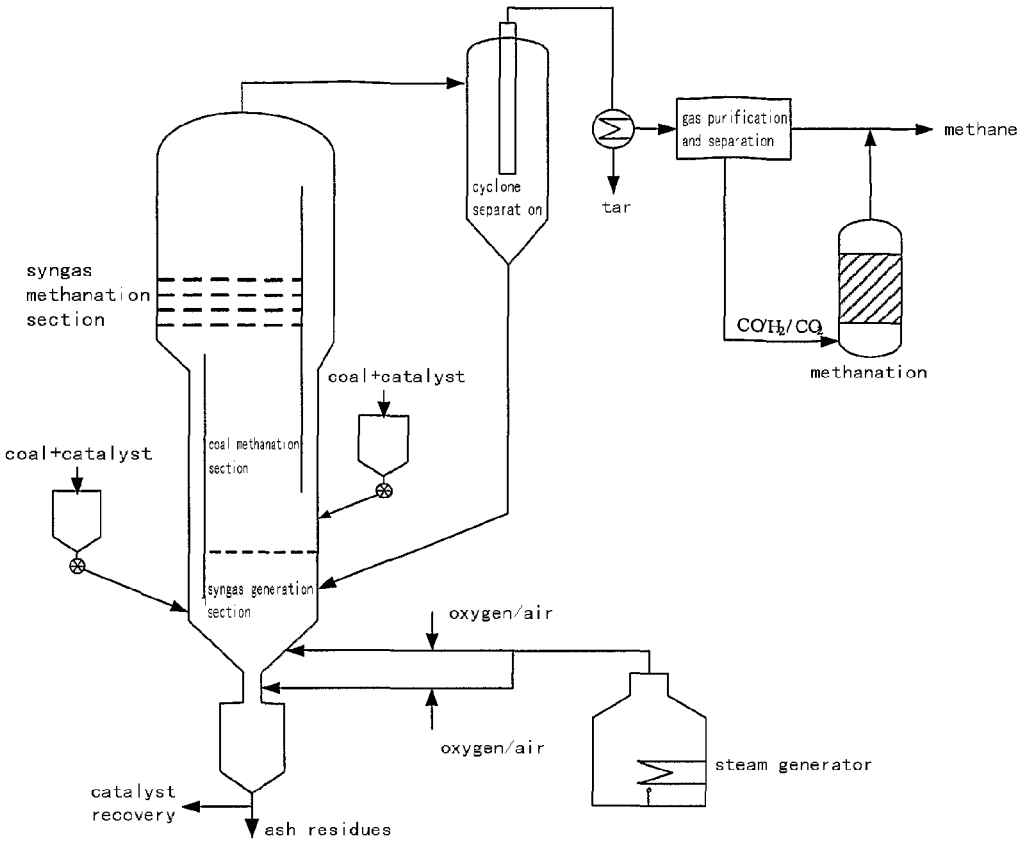
FIG. 4 is the schematic flowchart of the first embodiment of the invention.

The process of the invention will be described in detail by reference to FIG. 4. The key equipment used in the process of the invention is a gasifier with multiple sections. This gasifier is typically vertically disposed or obliquely disposed with an obliquity sufficient to let coal move down under the action of its gravity. This gasifier can be divided into the following three sections in turn from bottom to top according to the function of each section: syngas generation section, coal methanation section and syngas methanation section. Wherein the solid materials, such as coal, move from top to bottom, and finally exit the gasifier via an ash residue exit at the bottom of the gasifier, while the gaseous materials, move from bottom to top, and finally exit the gasifier via a gas exit at the top of the gasifier. In the gasifier, the solid materials contact with the gaseous materials basically in counter current mode. Regarding the temperature profile in the gasifier of the invention, the closer to the top, the temperature is lower, and the closer to the bottom, the temperature is higher.

In the process of the invention, the feeding points of the coal, the gaseous oxidant and the catalyst can be selected or adjusted as required. For example, at least part of coal can be introduced into the gasifier at any one or more points of the coal methanation section or the syngas methanation section or the optional coal pyrolysis section. Part of coal can even be introduced into the gasifier at the syngas generation section. The coal methanation catalyst can be introduced into the gasfier in two modes: for the catalyst capable of vaporizing at the high temperature of the syngas generation section in the invention, such as alkali metal carbonate, it can be introduced into the gasifier at coal methanation section and/or syngas methanation section and/or syngas generation section; for the catalyst not capable of vaporizing at the high temperature of the syngas generation section in the invention, such as alkali earth metal carbonate or alkali earth metal hydroxide, it can be introduced into the gasifier at coal methanation section and/or syngas methanation section. The gaseous oxidant is introduced into the gasifier at the bottom and/or side wall of the syngas generation section. The gaseous oxidant can be directly introduced into the gasifier, or can be introduced into the gasifier via a gas distributing plate located in the syngas generation section. In one embodiment, the gaseous oxidant can be divided into two sub-streams and then introduced into the syngas generation section, one sub-stream is introduced upwardly along the axial direction of the gas distributing plate at or near its bottom center, the other sub-stream is introduced upwardly in a certain angle with the axial direction of the gas distributing plate, so as to uniformly distribute the gaseous oxidant, wherein the certain angle can be 1-89°, preferably 10-70°, preferably 30-60°. Regardless of the feeding points of the coal and the catalyst, they will eventually contact with each other at the coal methanation section of the gasifier, and contact with the syngas-including gas stream at the same time. Obviously, the coal and the catalyst can also be fed in a mixture thereof. When they are fed in mixture thereof, their mixture can be fed at any one or more points of the coal methanation section or syngas methanation section or optional coal pyrolysis section. There is no limitation to the coal used in the invention. The coal can be selected from bituminous coal, anthracite or lignite, etc., and is preferably ground into coal powders before entering the gasifier of the invention. The particle size of the coal powders generally is 0.1~1 mm.

The step (a) of the invention is carried out in the coal methanation section of the gasifier. In this section, a methanation reaction is carried out by reacting the coal with a syngas-including gas stream coming from the syngas generation section in the presence of coal methanation catalyst, so as to generate a methane-containing gas stream and reacted char. Furthermore, the carbon gasification reaction and carbon monoxide shifting reaction, or the like, also occur. Wherein, the coal methanation catalyst is selected from alkali metal carbonate, alkali metal hydroxide, alkali metal oxide, alkali earth metal carbonate, alkali earth metal hydroxide, alkali earth metal oxide or a mixture thereof, such as sodium carbonate, potassium carbonate, lithium carbonate, potassium hydroxide, sodium hydroxide, or the like. The weight ratio of the coal methanation catalyst to the coal powders is 5%~15%. The main reaction occurs in this section is coal methanation reaction, that is:

$$C+H_2O \rightarrow CO+H_2-131\ kJ/mol$$

$$CO+H_2O \rightarrow CO_2+H_2+41\ kJ/mol$$

$$CO+3H_2 \rightarrow CH_4+H_2O+216\ kJ/mol$$

$$\text{Total reaction: } 2C+2H_2O \rightarrow CH_4+CO_2--5.4\ kJ/mol$$

The total reaction is a slight endothermic reaction. The reaction temperature in this section is typically 500-700° C. The heat needed in this section is provided by the high-temperature syngas-including gas stream coming from the syngas generation section. The methane-containing gas stream produced in this section also contains CO, $CO_2$ and unreacted water, etc. This gas stream enters upwardly the syngas methanation section of the gasifier. The reacted char produced in the coal methanation section is porous, and it moves downwardly via an overflow tube inside the gasifier under the action of its gravity and enters the syngas generation section of the gasifier, so as to carry out the step (b) of the invention.

The step (b) of the invention is carried out in the syngas generation section of the gasifier. The reacted char coming from step (a) enters downwardly the syngas generation section and reacts with the gaseous oxidant introduced into this section, wherein the gaseous oxidant is selected from a mixture of steam and oxygen or a mixture of steam and air. The main reactions occurred in this section are as follows:

$$2C+O_2 \rightarrow 2CO$$

$$C+O_2 \rightarrow CO_2$$

$$C+H_2O \rightarrow CO+H_2$$

These reactions generate the syngas-including gas stream and ash residues. The overall carbon conversion in this section can reach 90% or more. This section is named after the generation of much syngas. Wherein, the syngas-including gas stream also contains carbon dioxide and unreacted steam and oxygen, etc. This gas stream enters upwardly the coal methanation section to carry out step (a), while the ash residues exit the gasifier. Because a great deal of heat is released by the strong oxidation reaction occurred in this section, the temperature of this section is highest in the gasifier, which can be controlled at a temperature suitable for generating syngas (typically 800-1200° C.) by regulating the feeding rate and/or composition of the gaseous oxidant. In the syngas generation section, the mass ratio between the steam and the coal entered the gasifier is 0.5-5, and the mass ratio between the introduced oxygen and the coal entered the gasifier is typically 0.1-1. If the coal methanation catalyst used in the process of the invention can not be vaporized at the temperature of this section, the catalyst will exit the gasifier together with the ash residues and enter the catalyst recovery unit for recovery. If the coal methanation catalyst used in the process of the invention can be vaporized at the temperature of this section, the catalyst will be vaporized into vapour and enter upwardly the coal methanation section together with the syngas-including gas stream, then condense on the coal with the decrease of the gas temperature, and play a catalytic role again.

The step (c) of the invention is carried out in the syngas methanation section of the gasifier. The methane-containing gas stream from step (a) enters upwardly the syngas methanation section, and then the syngas is subjected to methanation reaction (i.e., $2CO+2H_2 \rightarrow CH_4+CO_2$) in the presence of a syngas methanation catalyst to produce additional methane, so as to obtain a gaseous product containing more methane. Wherein, the syngas methanation catalyst is selected from a sulfur-tolerant methanation catalyst, as the methane-containing gas stream coming from step (a) inevitably contains some sulfur compounds, such as $SO_x$ or $H_2S$ or COS, or the like, and the sulfur content in the gas phase may exceed 4%, so the syngas methanation catalyst is required to be tolerant to sulfur. The sulfur-tolerant methanation catalyst is selected from molybdenum sulfide, molybdenum oxide, cobalt oxide or molybdenum-cobalt-nickel eutectic supported on an alumina support or zirconia support. In the syngas methanation section, the syngas methanation catalyst is filled in the form of a fixed bed, preferably, the syngas methanation catalyst is located in the syngas methanation section in the form of an inner structure element such as a gas distributor and/or a baffle. By doing so, not only the syngas methanation catalyst is immobilized in the syngas methanation section, but also the upward movement of the gas stream is not influenced. The methanation occurs when the syngas passing through the catalyst bed and releases heat. The temperature in this section is typically 400-800° C.

Figure 5:
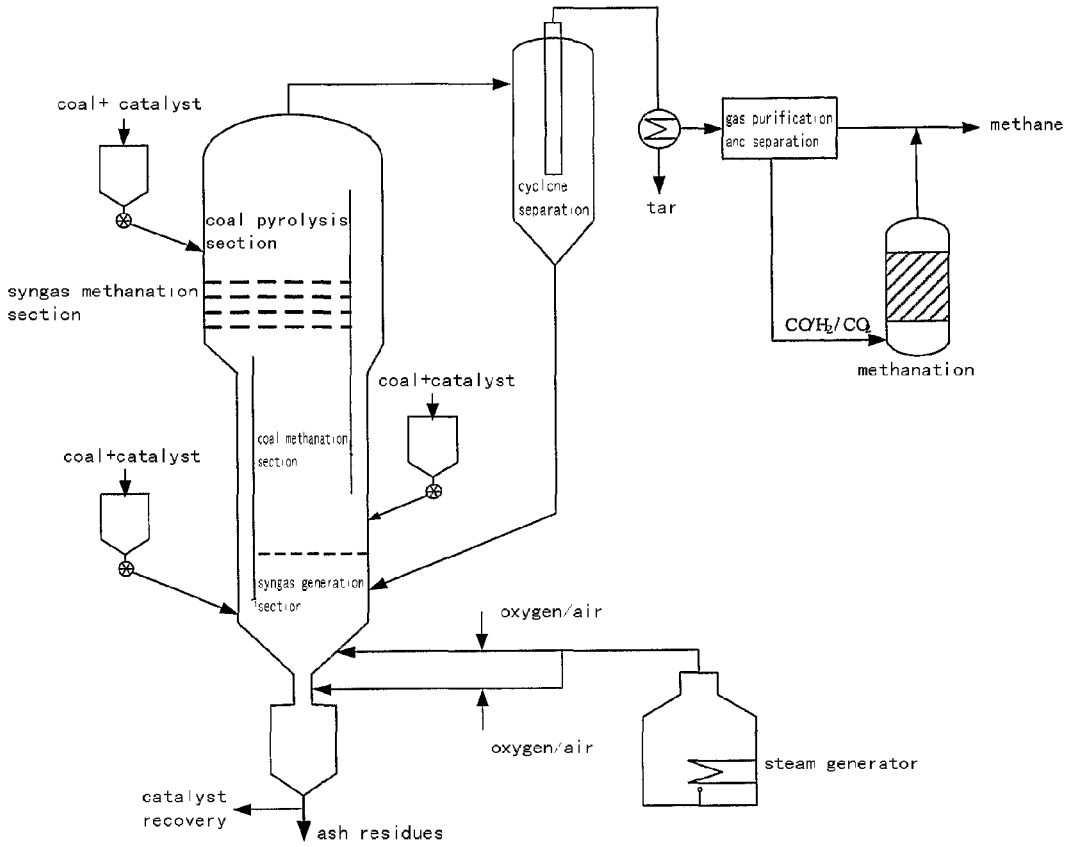
FIG. 5 is the schematic flowchart of the second embodiment to of the invention.

Alternatively, the invention can be carried out in another way. As shown in FIG. 5, the gasifier of the invention can be divided into four sections in turn from bottom to top according to the function of each section: a syngas generation section, a coal methanation section, a syngas methanation section and a coal pyrolysis section. Wherein, the reactions occurred in the first three sections are the same as that described in the steps (a), (b) and (c) of the above first type of embodiment, while the step (d) is carried out in the newly added coal pyrolysis section, that is, the gaseous product containing more methane enters upwardly the coal pyrolysis section and heats the coal introduced into the coal pyrolysis section to pyrolyze the coal so as to produce additional methane, and then all gases in this section exit the gasifier, while the pyrolyzed coal moves downwardly along the gasifier. In this embodiment, at least part of the coal, preferably most of the coal, even more preferably all coal is introduced into the gasifier at the coal pyrolysis section. The benefit of doing so is that the heat released from the syngas methanation reaction in the syngas methanation section is sufficiently used. The heat is introduced into the coal pyrolysis section together with the gaseous product containing more methane, and contacts with the coal introduced into the gasifier at the pyrolysis section, to preheat and rapidly pyrolyze the coal. The pyrolysis drives out the volatiles in the coal. As the volatiles contain methane, so not only the coal is preheat, but also the methane content of the gaseous product is further increased in this section. The char produced in the pyrolysis enters downwardly the lower sections via the overflow tube to continue to react. The temperature in the coal pyrolysis section is typically 500-600° C., which is regulated mainly by the flow rate of the gas coming from lower section and the feeding rate of the coal introduced into the coal pyrolysis section.

Figure 6:
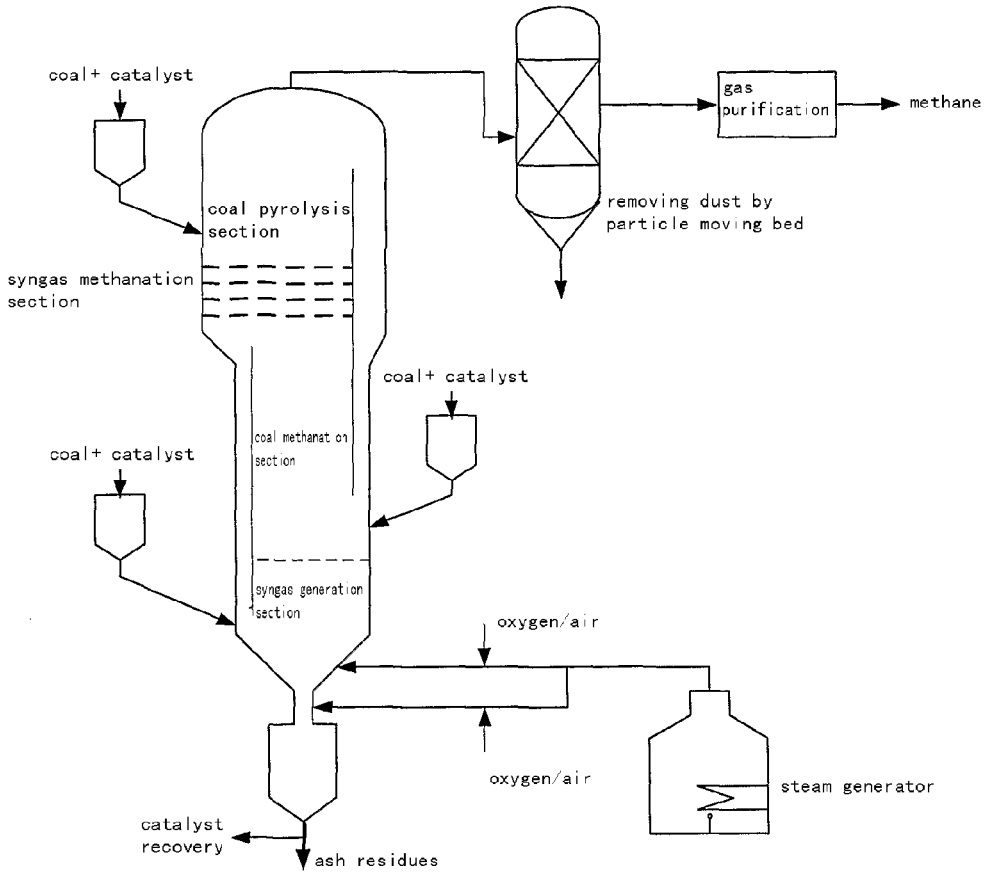
FIG. 6 is the schematic flowchart of a variant embodiment of the invention.

In despite that which embodiment described above is employed in the gasifier, the gaseous product containing more methane can enter a cyclone separator to carry out gas/solid separation after it exits the gasifier. The separated solid can be used elsewhere, or be optionally returned any section of the gasifier for reuse. The gaseous product containing more methane can enter a particle moving bed to carry out gas/solid separation after it exits the gasifier, as shown in FIG. 6, and the separated solid is optionally returned to any section of the gasifier or be optionally returned any section of the gasifier for reuse. Wherein, the syngas methanation catalyst is used as the dust-removing particles in the particle moving bed, the benefit of doing so is that the unreacted syngas can continue to react therein and generate additional methane gas to further increase the methane content. Wherein the syngas methanation catalyst is selected from a sulfur-tolerant methanation catalyst, said sulfur-tolerant methanation catalyst is selected from molybdenum sulfide, molybdenum oxide, cobalt oxide or molybdenum-cobalt-nickel eutectic or the like supported on an alumina support or zirconia support. The gas stream, whose dusts has been removed by the cyclone separator or the particle moving bed, is subjected to a tar-removing operation and gas purification and separation operations to obtain methane gas. Optionally, the separated gas, which contains CO, $H_2$ and $CO_2$, can be subjected to an additional methanation reaction to further obtain some methane.

In each embodiment of the invention, the pressure inside the gasifier is typically 3-4 MPa.

The advantage of the invention is that the following steps, i.e., the step of preparing syngas from coal, the step of catalytic methanation of the coal, the step of syngas methanation and the optional step of preheating and pyrolysis of the coal, are integrated into one gasifier with multiple sections, and that the energy and materials in each step can complement each other, so not only the flowchart is simplified, to but also the overall energy efficiency is greatly increased. Moreover, the sulfur-tolerant methanation catalyst is disposed in the form of the inner structure element in the syngas methanation section, such as gas distributing plate or a baffle or the like, the amount of this catalyst and the specific disposition can be determined according to the treating capacity of the gas. In this way, not only the movement characters of the solid phase and the gas phase in the multiple-section gasifier are not influenced, but also the much heat released from the reactions can be effectively used as heat sources for the coal pyrolysis. Another advantage of the invention is that process can be regulated in many means. The temperature in each section can be easily controlled by regulating the feeding rate and the feeding position of the coal, the composition and the feeding rate of the gasifying agent, or the like. For example, in the coal methanation section, when temperature of the coal methanation section is higher than optimal use temperature of the coal methanation catalyst because the heat carried by the syngas generated in the syngas generation section is too much, the temperature of this section can be regulated by adding additional coal thereto and by adjusting the adding amount of the coal.

The invention also relates to a gasifier for preparing methane by catalytically gasifying coal, which comprising a syngas generation section, a coal methanation section and a syngas methanation section in the order from bottom to top. Wherein, the coal methanation section is used to carry out methanation reaction by reacting the coal with a syngas-including gas stream coming from the syngas generation section in the presence of coal methanation catalyst, so as to generate a methane-containing gas stream and reacted char; and the syngas generation section is used to react the reacted char from coal methanation section with a gaseous oxidant introduced into the syngas generation section, producing the syngas-including gas stream and ash residues, wherein the syngas-including gas stream enters upwardly the coal methanation section, while the ash residues exit the gasifier; and the syngas methanation section is used to let the syngas in the methane-containing gas stream from the coal methanation section to be subjected to methanation reaction in the presence of a syngas methanation catalyst to produce additional methane, so as to obtain a gaseous product containing more methane.

As a preferred embodiment, the gasifier of the invention is additionally provided with a coal pyrolysis section above the syngas methanation section. The coal pyrolysis section is used to heat and partially pyrolyze the coal introduced into gasifier at this section by the gaseous product containing more methane coming from the syngas methanation section. Alternatively, as a more preferred embodiment, the gasifier of the invention is additionally provided with a sedimentation section above the coal pyrolysis section, the sedimentation section is used to let the relatively large solid particles carried by the gaseous product containing more methane to settle down back to the coal pyrolysis section before the gas product exit the gasifier, so as to alleviate the duty of the subsequent gas/solid separation step.

The gasifier of the invention additionally comprises feeding devices for feeding the gaseous oxidant, the coal and the catalyst into the gasifier, respectively; and discharging devices for discharging the gaseous product and solid product out of the gasifier, respectively. Such feeding devices and discharging devices are well know and commonly used by the skilled in the art, which are not discussed in detail herein.

The gasifier of the invention additionally comprises a gas distributing plate located in the syngas generation section to distribute the gas more uniformly.

The gasifier of the invention additionally comprises an inner structure element located in the syngas methanation section; said inner structure element is made of the syngas methanation catalyst. Wherein, the inner structure element includes a gas distributor and/or a baffle.

The gasifier of the invention additionally comprises an overflow tube to let the coal move downwardly.

Various embodiments of the invention have been described hereinbefore, but it is obvious for the skilled in the art that many obvious modifications can be made to the invention according to the teaching of the invention. Though the invention is described by taking coal as an example, it is obvious that the process of the invention can also used to treat petroleum coke or biomass.

The invention claimed is:

1. A process for preparing methane by catalytically gasifying coal, comprising the following steps:

(a) providing a gasifier comprising a syngas generation section, a coal methanation section and a syngas methanation section, and carrying out methanation reaction by reacting the coal with a syngas-including gas stream coming from the syngas generation section in the presence of coal methanation catalyst in the coal methanation section, so as to generate a methane-containing gas stream and reacted char;

(b) the reacted char enters downwardly the syngas generation section and reacts with a gaseous oxidant introduced into the syngas generation section, producing the syngas-including gas stream and ash residues, wherein the syngas-including gas stream enters upwardly the coal methanation section to carry out step (a), while the ash residues exit the gasifier; and, (c) the methane-containing gas stream from step (a) enters upwardly the syngas methanation section, and the syngas is subjected to methanation reaction in the presence of a syngas methanation catalyst to produce additional methane, so as to obtain a gaseous product containing more methane;

wherein solid materials move from top to bottom, and finally exit the gasifier via an ash residue exit at the bottom of the gasifier, while gaseous materials move from bottom to top, and finally exit the gasifier via a gas exit at the top of the gasifier; in the gasifier the solid materials contact with the gaseous materials basically in counter current mode.

2. The process according to claim 1, wherein at least part of the coal is introduced into the gasifier at the coal methanation section and/or syngas methanation section of the gasifier.

3. A process for preparing methane by catalytically gasifying coal, comprising steps:

(a) providing a gasifier comprising a syngas generation section, a coal methanation section, a syngas methanation section and a coal pyrolysis section, and carrying out methanation reaction by reacting the coal with a syngas-including gas stream coming from the syngas generation section in the presence of coal methanation catalyst in the coal methanation section, so as to generate a methane-containing gas stream and reacted char;

(b) the reacted char enters downwardly the syngas generation section and reacts with a gaseous oxidant introduced into the syngas generation section, producing the syngas-including gas stream and ash residues, wherein the syngas-including gas stream enters upwardly the coal methanation section to carry out step (a), while the ash residues exit the gasifier;

(c) the methane-containing gas stream from step (a) enters upwardly the syngas methanation section, and the syngas is subjected to methanation reaction in the presence of a syngas methanation catalyst to produce additional methane, so as to obtain a gaseous product containing more methane; and, (d) the gaseous product containing more methane enters upwardly the coal pyrolysis section and heats the coal introduced into the coal pyrolysis section to pyrolyze the coal and produce additional methane, and all gases in this section exit the gasifier, while the pyrolyzed coal moves downwardly along the gasifier, wherein solid materials move from top to bottom, and finally exit the gasifier via an ash residue exit at the bottom of the gasifier, while gaseous materials move from bottom to top, and finally exit the gasifier via a gas exit at the top of the gasifier; in the gasifier the solid materials contact with the gaseous materials basically in counter current mode.

4. The process according to claim 3, wherein at least part of the coal is introduced into the gasifier at the coal pyrolysis section.

5. The process according to claim 1 or 3, wherein the coal methanation catalyst is introduced into the gasifier at the coal methanation section and/or syngas methanation section and/or syngas generation section of the gasifier.

6. The process according to claim 1 or 3, wherein the gaseous oxidant is introduced into the gasifier at the bottom and/or side wall of the syngas generation section.

7. The process according to claim 1 or 3, wherein the syngas methanation catalyst is located in the syngas methanation section in the form of a fixed bed.

8. The process according to claim 1 or 3, wherein the syngas methanation catalyst is located in the syngas methanation section in the form of an inner structure element of the gasifier.

9. The process according to claim 8, wherein the inner structure element comprises a gas distributor and/or a baffle.

10. The process according to claim 1 or 3, wherein the coal methanation catalyst is selected from alkali metal carbonate, alkali metal hydroxide, alkali metal oxide, alkali earth metal carbonate, alkali earth metal hydroxide, alkali earth metal oxide or a mixture thereof.

11. The process according to claim 1 or 3, wherein the syngas methanation catalyst is selected from a sulfur-tolerant methanation catalyst.

12. The process according to claim 11, wherein the sulfur-tolerant methanation catalyst is selected from molybdenum sulfide, molybdenum oxide, cobalt oxide or molybdenum-cobalt-nickel eutectic supported on an alumina support or zirconia support.

13. The process according to claim 1 or 3, wherein the gaseous oxidant is selected from a mixture of steam and oxygen or a mixture of steam and air.

14. The process according to claim 1 or 3, wherein the gaseous product from step (c) or step (d) exits the gasifier and then enters a cyclone separator to carry out gas/solid separation, and the separated solid is optionally returned to any section of the gasifier.

15. The process according to claim 1 or 3, wherein the gaseous product from step (c) or step (d) exits the gasifier and then enters a particle moving bed to carry out gas/solid separation, and the separated solid is optionally returned to any section of the gasifier.

16. The process according to claim 15, wherein the syngas methanation catalyst is used as the dust-removing particles in the particle moving bed to generate additional methane gas.

17. The process according to claim 16, wherein the syngas methanation catalyst is selected from a sulfur-tolerant methanation catalyst.

18. The process according to claim 17, wherein the sulfur-tolerant methanation catalyst is selected from molybdenum sulfide, molybdenum oxide, cobalt oxide or molybdenum-cobalt-nickel eutectic supported on an alumina support or zirconia support.

19. The process according to claim 1 or 3, wherein the gaseous oxidant is introduced into the gasifier via a gas distributing plate located in the syngas generation section.

20. The process according to claim 19, wherein the gaseous oxidant is divided into two sub-streams and then introduced into the syngas generation section, one sub-stream is introduced upwardly along the axial direction of the gas distributing plate at or near its bottom center, the other sub-stream is introduced upwardly in a certain angle with the axial direction of the gas distributing plate.

21. The process according to claim 1 or 3, wherein the temperature of the syngas generation section is controlled at a temperature suitable for generating syngas by regulating the feeding rate and/or composition of the gaseous oxidant entering the syngas generation section.

22. The process according to claim 21, wherein the temperature suitable for generating syngas is 800-1200° C.

23. The process according to claim 1 or 3, wherein the mass ratio between the steam in the syngas generation section and the coal entered the gasifier is 0.5-5, and the mass ratio between the oxygen and the coal entered the gasifier is 0.1-1.

24. The process according to claim 1 or 3, wherein the temperature of the coal methanation section is regulated by adding additional coal to this section and adjusting the amount of said additional coal.

25. The process according to claim 1 or 3, wherein the temperature of the coal methanation section is 500-700° C., and the temperature of the syngas methanation section is 400-800° C.

26. The process according to claim 3, wherein the temperature of the coal pyrolysis section is 500-600° C.

27. The process according to claim 1 or 3, wherein the pressure inside the gasifier is 3-4 MPa.

28. The process according to claim 1 or 3, wherein the coal is selected from bituminous coal, anthracite or lignite.

29. The process according to claim 1 or 3, wherein the coal is replaced with petroleum coke or biomass.

30. A gasifier for preparing methane by catalytically gasifying coal, which comprises a syngas generation section, a coal methanation section and a syngas methanation section in the order from bottom to top, wherein, the coal methanation section is used to carry out methanation reaction by reacting the coal with a syngas-including gas stream coming from the syngas generation section in the presence of coal methanation catalyst, so as to generate a methane-containing gas stream and reacted char;

the syngas generation section is used to react the reacted char from coal methanation section with a gaseous oxidant introduced into the syngas generation section, producing the syngas-including gas stream and ash residues, wherein the syngas-including gas stream enters upwardly the coal methanation section, while the ash residues exit the gasifier;

the syngas methanation section is used to let the syngas in the methane-containing gas stream from the coal methanation section to be subjected to methanation reaction in the presence of a syngas methanation catalyst to produce additional methane, so as to obtain a gaseous product containing more methane, wherein solid materials move from top to bottom, and finally exit the gasifier via an ash residue exit at the bottom of the gasifier, while gaseous materials move from bottom to top, and finally exit the gasifier via a gas exit at the top of the gasifier; in the gasifier the solid materials contact with the gaseous materials basically in counter current mode.

31. The gasifier according to claim 30, which is additionally provided with a coal pyrolysis section above the syngas methanation section, the coal pyrolysis section is used to heat and partially pyrolyze the coal introduced into gasifier at the coal pyrolysis section by the gaseous product containing more methane coming from the syngas methanation section.

32. The gasifier according to claim 30 or 31, which additionally comprises:

feeding devices for feeding the gaseous oxidant, the coal and the catalyst into the gasifier, respectively; and discharging devices for discharging the gaseous product and solid product out of the gasifier, respectively.

33. The gasifier according to claim 30 or 31, which additionally comprises a gas distributing plate located in the syngas generation section.

34. The gasifier according to claim 30 or 31, which additionally comprises an inner structure element located in the syngas methanation section, said inner structure element is made of the syngas methanation catalyst.

35. The gasifier according to claim 34, wherein the inner structure element comprises a gas distributor and/or a baffle.

36. The gasifier according to claim 30 or 31, which additionally comprises an overflow tube to let the coal move downwardly.

* * * * *

UNITED STATES PATENT AND TRADEMARK OFFICE

CERTIFICATE OF CORRECTION

PATENT NO. : 9,000,056 B2
APPLICATION NO. : 13/496035
DATED : April 7, 2015
INVENTOR(S) : Bi et al.

It is certified that error appears in the above-identified patent and that said Letters Patent is hereby corrected as shown below:

Title Page, Item (30) please delete "2009 0 0170389" and replace it with --2009 1 0170389.3--.

Signed and Sealed this
Twenty-third Day of August, 2016

Michelle K. Lee

Michelle K. Lee
*Director of the United States Patent and Trademark Office*